US010573258B2

(12) United States Patent
Kim et al.

(10) Patent No.: US 10,573,258 B2
(45) Date of Patent: Feb. 25, 2020

(54) DISPLAY DEVICE AND DRIVING METHOD THEREOF

(71) Applicant: Samsung Display Co., Ltd., Yongin-si (KR)

(72) Inventors: Myeong Su Kim, Hwaseong-si (KR); Jae Ho Choi, Seoul (KR); Sil Yi Bang, Yongin-si (KR); Kuk-Hwan Ahn, Hwaseong-si (KR); Kwan-Young Oh, Hanam-si (KR); Sang Su Han, Hanam-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 89 days.

(21) Appl. No.: 15/718,806

(22) Filed: Sep. 28, 2017

(65) Prior Publication Data

US 2018/0090083 A1 Mar. 29, 2018

(30) Foreign Application Priority Data

Sep. 29, 2016 (KR) ..... 10-2016-0125933

(51) Int. Cl.
*G09G 3/36* (2006.01)

(52) U.S. Cl.
CPC ..... *G09G 3/3607* (2013.01); *G09G 3/3666* (2013.01); *G09G 3/3677* (2013.01); *G09G 3/3688* (2013.01); *G09G 2310/027* (2013.01); *G09G 2320/0223* (2013.01); *G09G 2320/0233* (2013.01); *G09G 2320/0673* (2013.01)

(58) Field of Classification Search
CPC .. G09G 3/3607; G09G 3/3666; G09G 3/3677; G09G 3/3688; G09G 2310/027; G09G 2320/0223; G09G 2320/0233; G09G 2320/0673
See application file for complete search history.

(56) References Cited

U.S. PATENT DOCUMENTS

2013/0083083 A1* 4/2013 Woo ..... G09G 3/3208 345/690
2013/0249969 A1* 9/2013 Jeon ..... G09G 5/10 345/691

FOREIGN PATENT DOCUMENTS

KR 100885015 2/2009
KR 1020120072724 7/2012
(Continued)

*Primary Examiner* — Nelson M Rosario
(74) *Attorney, Agent, or Firm* — Cantor Colburn LLP

(57) ABSTRACT

A display device includes a display panel including a plurality of pixels and divided into a plurality of regions, a data driver generating a plurality of reference gamma voltages based on a gamma control signal and including a data driving integrated circuit applying a data signal generated using the plurality of reference gamma voltages to a corresponding pixel among the plurality of pixels, a memory storing a plurality of gamma voltage data corresponding to a plurality of gamma curves of each of the plurality of regions, and a signal controller determining characteristics of a plurality of images divided and displayed in the plurality of regions using an input image signal, selecting the gamma curves corresponding to the plurality of regions according to the characteristics, and reading gamma voltage data corresponding to the selected gamma curve from the memory to generate the gamma control signal.

11 Claims, 7 Drawing Sheets

(56) References Cited

FOREIGN PATENT DOCUMENTS

| | | |
|---|---|---|
| KR | 1020150078648 | 7/2015 |
| KR | 1020160057028 | 5/2016 |

* cited by examiner

DISPLAY DEVICE AND DRIVING METHOD THEREOF

This application claims priority to Korean Patent Application No. 10-2016-0125933 filed on Sep. 29, 2016, and all the benefits accruing therefrom under 35 U.S.C. § 119, the content of which in its entirety is herein incorporated by reference.

BACKGROUND (a) Field

Exemplary embodiments of the invention relate to a display device and a driving method thereof.

(b) Description of the Related Art

A display device is used for various kinds of electric products such as a mobile phone, a tablet PC, a laptop, a TV, etc., for example. The display device includes a liquid crystal display ("LCD"), an organic light emitting diode ("OLED") display, etc., for example.

In general, the display device includes a display panel including a plurality of pixels, a gate line connected to the plurality of pixels to transmit a gate signal, and a data line connected to the plurality of pixels to transmit a data voltage.

SUMMARY

In recent years, a display panel of a display device has been becoming larger and thinner. Accordingly, when transmitting the same data voltage to pixels positioned at different regions from each other of the display panel, a magnitude of the data voltage transmitted to each pixel may be different due to parasitic resistance of the data line.

Also, when transmitting gate signal to the pixels positioned at the different regions, in case that the gate signal transmitted to the pixel separated from one side of the display panel is delayed by a resistance-capacitance ("RC") delay, charge times of the data voltages applied to the pixels may be different from each other.

Resultantly, since the magnitude of the data voltage and application timing of the gate signal are changed due to the region in which the pixel is positioned, a display failure such as luminance non-uniformity may be generated.

Exemplary embodiments provide a display device improving the luminance non-uniformity depending on a gamma deviation for each partial region of the display panel, and a driving method thereof.

Exemplary embodiments provide a display device improving visibility of a display image according to a characteristic of an input image for each partial region, and a driving method thereof.

A display device according to an exemplary embodiment includes a display panel including a plurality of pixels and divided into a plurality of regions, a data driver which generates a plurality of reference gamma voltages depending on a gamma control signal and includes a data driving integrated circuit ("IC") which applies a data signal generated using the plurality of reference gamma voltages to a corresponding pixel among the plurality of pixels, a memory which stores a plurality of gamma voltage data corresponding to a plurality of gamma curves corresponding to each of the plurality of regions, and a signal controller which determines a characteristic of a plurality of images divided and displayed in the plurality of regions using an input image signal, selects a gamma curve of the plurality of gamma curves corresponding to the plurality of regions depending on the characteristic, and reads gamma voltage data corresponding to the selected gamma curve from the memory to generate the gamma control signal.

In an exemplary embodiment, a gate driver which transmits a corresponding gate signal to a plurality of gate lines connected to the plurality of pixels may be further included, and the plurality of regions may be divided by at least one gate line among the plurality of gate lines.

In an exemplary embodiment, the data driver may be connected to the plurality of pixels by a plurality of data lines, and the plurality of regions may be further divided by at least one data line.

In an exemplary embodiment, the signal controller may determine the characteristics using a gray value of the plurality of pixels included in a plurality of image signals.

In an exemplary embodiment, the signal controller may correct a gray value of pixels of the plurality of pixels included in a boundary region of adjacent regions of the plurality of regions when the different gamma curves are selected in the adjacent regions among the plurality of regions.

In an exemplary embodiment, the boundary region may include a first boundary region and a second boundary region respectively included in the adjacent regions, and the signal controller may correct the gray value of the pixels included in the first boundary region and the second boundary region depending on a luminance difference by the gray value of the pixels include in the first boundary region and the gray value of the pixels include in the second boundary region.

In an exemplary embodiment, the signal controller may correct the gray value of the pixels included in the first boundary region and the second boundary region based on a difference between the luminance depending on the gray value of the pixel included in the first boundary region and the luminance depending on the gray value of the pixel included in the second boundary region for the same gamma curve to offset an increase or decrease of the difference between the luminance depending on the gray value of the pixel included in the first boundary region and the luminance depending on the gray value of the pixel included in the second boundary region for the different gamma curves.

In an exemplary embodiment, the gamma voltage data may be generated using the luminance measured by providing a plurality of test voltages corresponding to a plurality of sample grays to the plurality of regions.

In an exemplary embodiment, the signal controller may packetize image data depending on the gamma control signal and the input image signal by a unit of the plurality of pixels connected to one gate line to be transmitted to the data driver.

A method for driving a display device according to an exemplary embodiment includes receiving an image signal, determining a characteristic of a plurality of images divided depending on a plurality of regions of a display panel displaying an image depending on the image signal, selecting gamma curves corresponding to the plurality of regions depending on characteristics, reading gamma voltage data of a plurality of gamma voltage data corresponding to the selected gamma curve from a memory in which the plurality of gamma voltage data corresponding to a plurality of gamma curves of each of the plurality of regions to generate a gamma control signal are stored, and generating a plurality of reference gamma voltages depending on the gamma control signal.

In an exemplary embodiment, the determining the characteristics may include determining the characteristics using a gray value of pixels included in a plurality of image signals.

In an exemplary embodiment, the driving method may further include determining whether gamma curves that are different from each other are selected in adjacent regions among the plurality of regions, and correcting gray value of the pixels included in a boundary region of the adjacent regions depending on a determination result.

In an exemplary embodiment, the correcting the gray value may include correcting the gray value of the pixels included in the first boundary region and the second boundary region depending on a luminance difference by the gray value of the pixels included in the first boundary region and the gray value of the pixels included in the second boundary region when the boundary region includes a first boundary region and a second boundary region that are respectively positioned at the adjacent regions.

In an exemplary embodiment, the correcting the gray value of the pixels included in the first boundary region and the second boundary region may include correcting the gray value of the pixels included in the first boundary region and the second boundary region based on a difference between the luminance depending on the gray value of the pixel included in the first boundary region and the luminance depending on the gray value of the pixel included in the second boundary region for the same gamma curve to offset an increase or decrease of the difference between the luminance depending on the gray value of the pixel included in the first boundary region and the luminance depending on the gray value of the pixel included in the second boundary region for the different gamma curves of the plurality of gamma curves.

In an exemplary embodiment, the generating the gamma control signal may include packetizing image data depending on the gamma control signal and the image signal by a unit of one horizontal line.

According to exemplary embodiments, the display device having the uniform luminance may be provided.

Also, according to exemplary embodiments, the display device with improved visibility may be provided.

BRIEF DESCRIPTION OF THE DRAWINGS

The above and other exemplary embodiments, advantages and features of this disclosure will become more apparent by describing in further detail exemplary embodiments thereof with reference to the accompanying drawings, in which.

DETAILED DESCRIPTION

Figure 1:
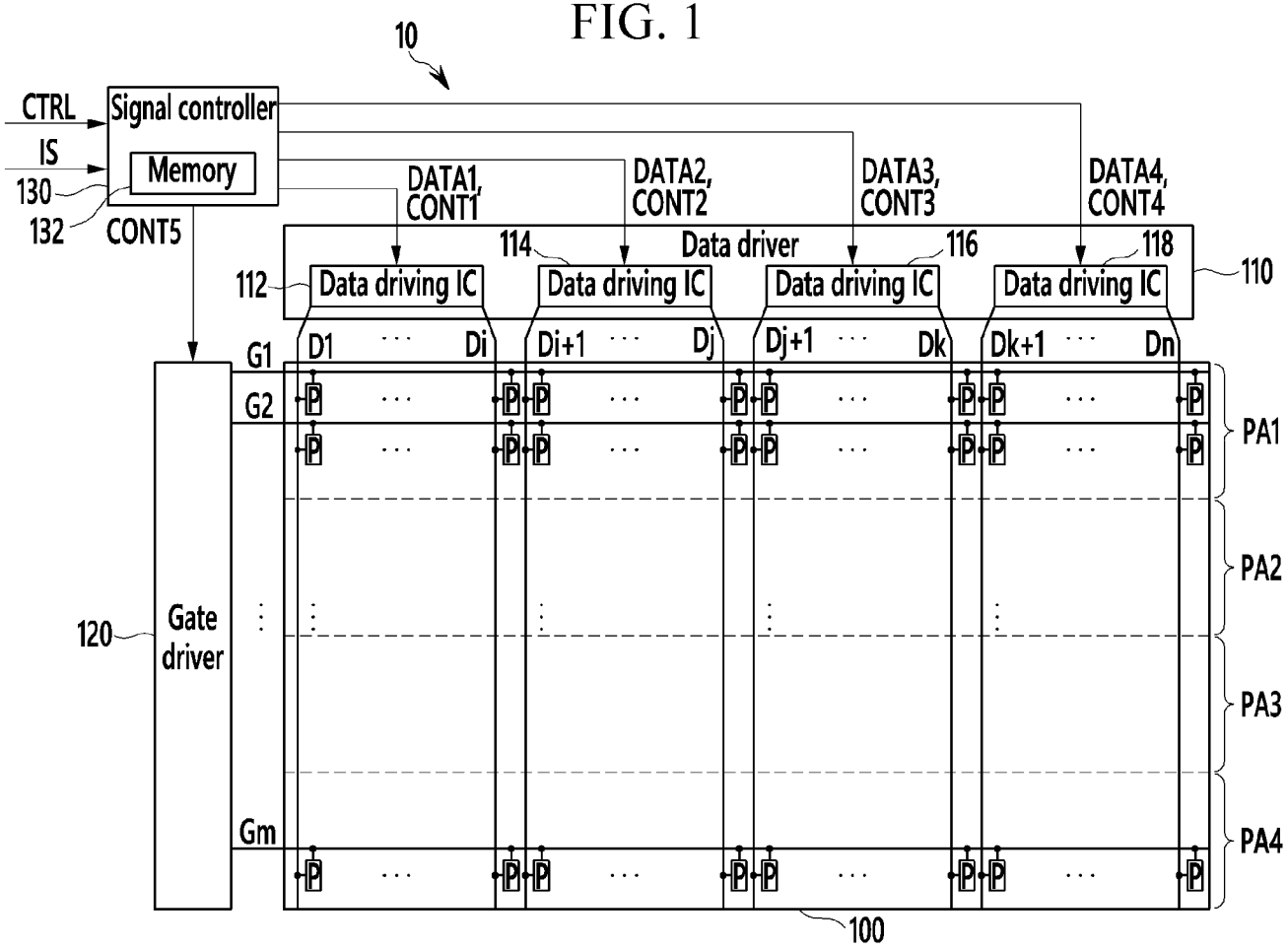
FIG. 1 is a schematic block diagram of an exemplary embodiment of a display device

The invention will be described more fully hereinafter with reference to the accompanying drawings, in which exemplary embodiments are shown. As those skilled in the art would realize, the described embodiments may be modified in various different ways, all without departing from the spirit or scope of the invention.

In order to clearly explain the invention, portions that are not directly related to the invention are omitted, and the same reference numerals are attached to the same or similar constituent elements through the entire specification.

In addition, unless explicitly described to the contrary, the word "comprise" and variations such as "comprises" or "comprising" or "includes" and variations such as "includes" or "including" will be understood to imply the inclusion of stated elements but not the exclusion of any other elements.

It will be understood that when an element is referred to as being "on" another element, it can be directly on the other element or intervening elements may be therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. In an exemplary embodiment, when the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, when the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the invention, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. In an exemplary embodiment, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims.

A display device 10 according to an exemplary embodiment will be described with reference to FIG. 1.

FIG. 1 is a schematic block diagram of a display device according to an exemplary embodiment. As shown in the drawing, the display device 10 includes a display panel 100, a data driver 110, a gate driver 120, and a signal controller 130.

The display panel 100 includes a plurality of display signal lines and a plurality of pixels P connected the plurality of display signal lines. The display signal line includes a plurality of gate lines G1 to Gm transmitting a gate signal (also referred to as "a scanning signal"), and a plurality of data lines D1 to Dn transmitting a data voltage. The plurality of pixels P may be respectively connected to the corresponding gate lines G1 to Gm and the corresponding data lines D1 to Dn, where n is a natural number. The plurality of pixels P may include a liquid crystal display element or an organic light emitting element.

The data driver 110 connected to the data lines D1 to Dn of the display panel 100 applies a plurality of data voltages to the data lines D1 to Dn. The data driver 110 includes a plurality of data driving integrated circuits ("ICs") 112, 114, 116, and 118. Each of the data driving ICs 112, 114, 116, and 118 may output the data voltage to the corresponding data lines among the plurality of data lines D1 to Dn. In FIG. 1, the data driver 110 includes four data driving ICs 112, 114, 116, and 118, but is not limited thereto.

In detail, the data driving ICs 112, 114, 116, and 118 may generate the data voltages for all grays using a reference gamma voltage. Also, each of the data driving ICs 112, 114, 116, and 118 generates the data voltage using corresponding data control signals CONT1 to CONT4 and input image data DATA1 to DATA4, and outputs the generated data voltage as the data signal to the data lines D1 to Dn.

These data driving ICs 112, 114, 116, and 118 will be further described with reference to FIG. 5.

The gate driver 120 is connected to the gate lines G1 to Gm and transmits a gate signal including a combination of a gate-on voltage and a gate-off voltage to the gate lines G1 to Gm.

The gate driver 120 applies the gate-on voltage to the gate lines G1 to Gm depending on a gate control signal CONT5 from the signal controller 130. Thus, the data voltage applied to the data lines D1 to Dn may be applied to the corresponding pixel.

Although not shown, when the display panel 100 is the liquid crystal panel, a backlight unit may be positioned at a back side of the display panel 100 and may include at least one light source. As an example of the light source, a fluorescent lamp such as a cold cathode fluorescent lamp ("CCFL") or a light emitting diode ("LED") may be included.

The signal controller 130 controls an operation of the gate driver 120 and the data driver 110.

The signal controller 130 receives an input image signal IS and an input control signal CTRL. In an exemplary embodiment, the input image signal IS includes luminance information of each pixel of the display panel 100, and the luminance may be classified into a predetermined number of grays, for example, 1024, 256, or 64. In an exemplary embodiment, the input control signal CTRL may include a vertical synchronization signal and a horizontal synchronizing signal that are related to image display, a main clock signal, a data enable signal, etc., for example.

The signal controller 130 appropriately processes the input image signal IS based on the input image signal IS and the input control signal CTRL to be suitable to the operating conditions of the display panel 100, and may generate image data DATA1 to DATA4, data control signals CONT1 to CONT4, and a gate control signal CONT5.

The signal controller 130 includes a memory 132 in which a plurality of gamma voltage data corresponding to each region of the display panel 100 is stored. In an exemplary embodiment, the memory 132 may be an erasable programmable read-only memory ("EEPROM"), for example. The signal controller 130 may generate the image data DATA1 to DATA4 and the data control signals CONT1 to CONT4 with reference to the plurality of gamma voltage data stored to the memory 132.

In an exemplary embodiment, the display panel 100 is divided into a plurality of regions PA1, PA2, PA3, and PA4 depending on a distance between the pixel P and the data driving ICs 112, 114, 116, and 118, for example. The signal controller 130 may determine the gamma characteristic of the corresponding region based on each image characteristic of the plurality of regions PA1, PA2, PA3, and PA4. One gamma characteristic may be defined by a correlation between the grays and the luminance corresponding to the grays, and the correlation thereof may be represented as a gamma curve.

When the plurality of data voltages corresponding to the plurality of grays is applied to the pixels of one region, a plurality of luminance values measured from the pixels of the corresponding region must satisfy the gamma curve predetermined for the corresponding region. The gamma voltage data includes information for the reference gamma voltage to generate the data voltage depending on the gamma curve of the corresponding region. Also, since the plurality of gamma curves corresponding to one region exists, the gamma voltage data includes the information for the reference gamma voltages for each of the plurality of gamma curves in one region.

In an exemplary embodiment, in the first region PA1, the information for the reference gamma voltages to express the 1.8 gamma curve, the information for the reference gamma voltages to express the 2.0 gamma curve, and the information for the reference gamma voltage to express the 2.2 gamma curve may be stored to the memory 132, for example. Likewise, in the second region PA2, the information for the reference gamma voltages to express the 1.8 gamma curve, the information for the reference gamma voltages to express the 2.0 gamma curve, and the information for the reference gamma voltage to express the 2.2 gamma curve may be stored to the memory 132, for example. Also, the reference gamma voltages to express the 1.8 gamma curve in the first region PA1 and the reference gamma voltages to express the 1.8 gamma curve in the second region PA2 may have different values from each other.

Resultantly, in the memory 132, the plurality of gamma voltage data corresponding to the plurality of gamma curves for each of the plurality of regions PA1, PA2, PA3, and PA4 is stored.

By applying a test voltage to the display panel 100 and measuring the luminance of the display panel 100 depending on the test voltages of a plurality of sample grays, the gamma voltage data may be generated.

In an exemplary embodiment, the test voltage corresponding to the first gray value is applied to one region of the display panel 100 to generate the gamma voltage data, for example. The test voltage may be generated using at least one reference gamma voltage. When the luminance of the region to which the test voltage is applied is measured, it is determined whether the first gray value and the measured luminance value satisfy the first gamma curve, and the value of at least one reference gamma voltage used to generate the test voltage is adjusted when the first gray value and the measured luminance value do not satisfy the first gamma curve. The test voltage is regenerated using the adjusted reference gamma voltage, and the regenerated test voltage is applied to one region of the display panel 100. Also, the luminance of the region to which the regenerated test voltage is applied is measured to determine whether the first gray value and the regenerated luminance value satisfy the first gamma curve. By the same method, the plurality of reference gamma voltages corresponding to the first gamma curve is set in one region. Also, the information for the plurality of reference gamma voltage corresponding to the first gamma curve is generated as the gamma voltage data in one region.

The method of generating the information for the reference gamma voltage to generate the data voltage corresponding to one region of the display panel 100 and satisfying one gamma curve may be realized by other methods as well as the above-described method, so it is not limited to the above-described method.

Next, a driving method of the display device 10 according to an exemplary embodiment will be described with reference to FIGS. 2 to 4.

Figure 2:
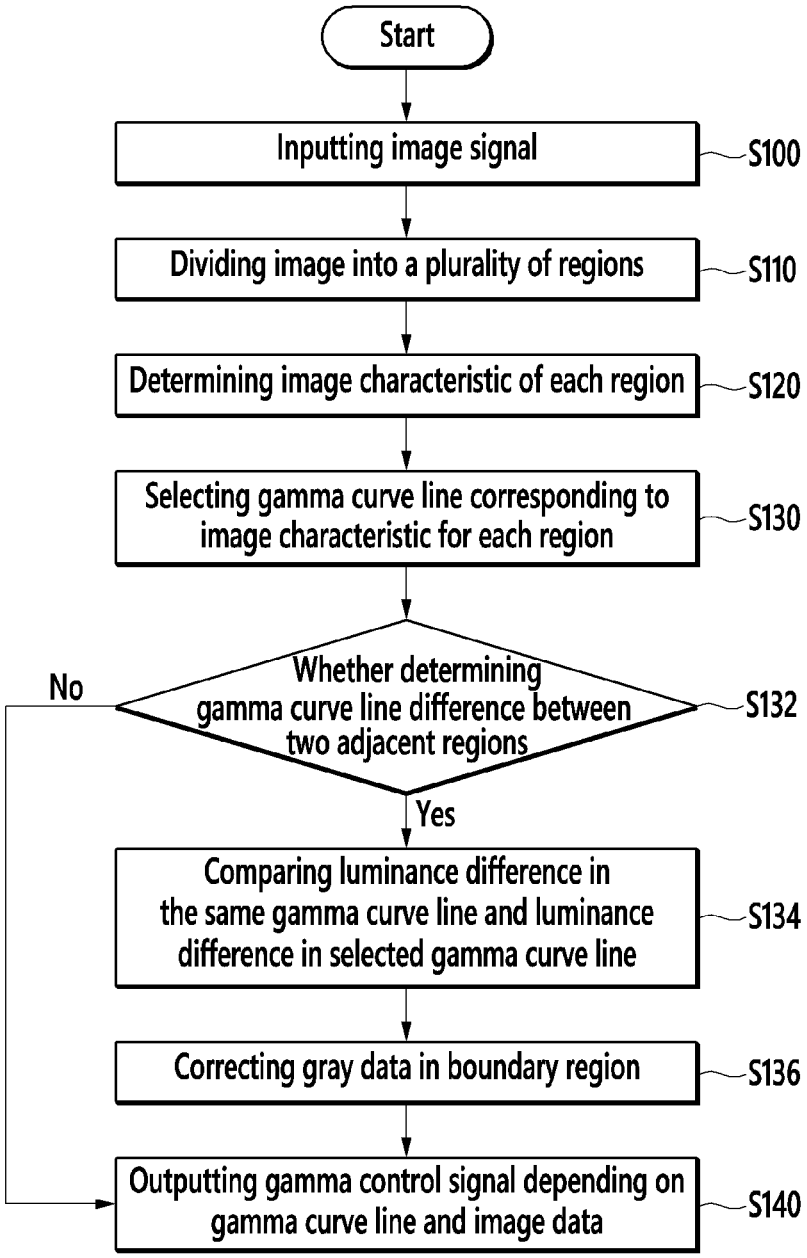
FIG. 2 is a flowchart of an exemplary embodiment of a driving method of a display device.
Figure 3:
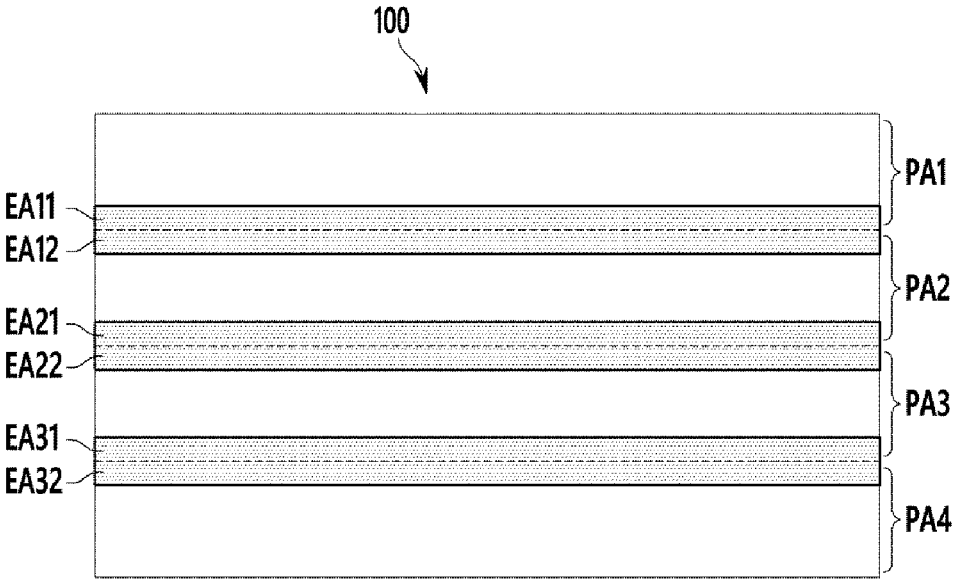
FIG. 3 is a view showing one example of a display panel of a display device.
Figure 4:
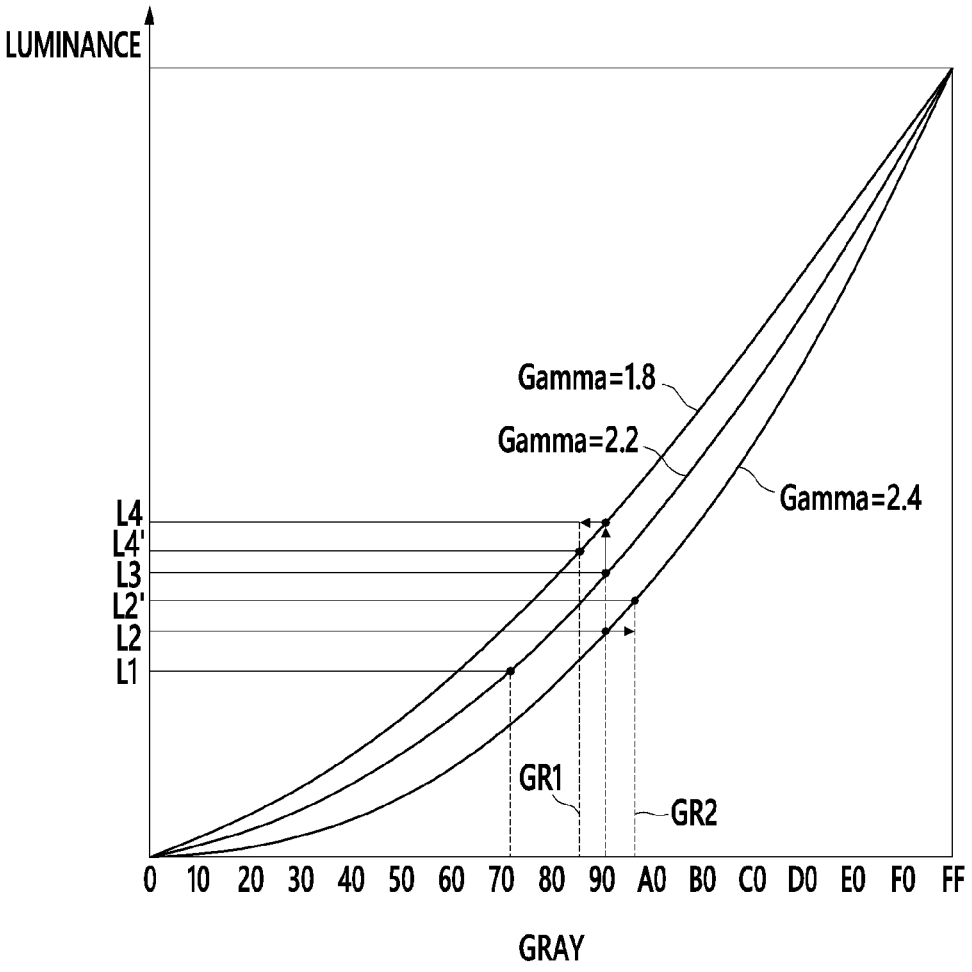
FIG. 4 is a graph showing one example of gamma curves applied to a display device.

FIG. 2 is a flowchart of a driving method of a display device according to an exemplary embodiment, FIG. 3 is a view showing one example of a display panel of a display device, and FIG. 4 is a graph showing one example of gamma curves applied to of a display device according to an exemplary embodiment.

As shown in FIGS. 1 and 2, the signal controller 130 receives the image signal IS (S100). The image signal IS input from the outside may be the image data for displaying the two dimensional ("2D") image and the image data for displaying the three dimensional ("3D") image. Hereinafter, it is assumed that the image signal IS is the 2D image signal including the plurality of gray values corresponding to the plurality of pixels P by one frame unit.

Next, the signal controller 130 divides the image of the image signal IS into the plurality of regions PA1, PA2, PA3, and PA4 (S110). In an exemplary embodiment, when the image according to the image signal IS is displayed on the display panel 100, the image is divided corresponding to each region of the display panel 100. The signal controller 130 divides the image of the image signal IS into the image (hereinafter referred to as a first image) displayed in the first region PA1 of the display panel 100, the image (hereinafter referred to as a second image) displayed in the second region PA2, the image displayed in the third region PA3, and the image displayed in the fourth region PA4, for example.

The signal controller 130 determines the image characteristic of each region (S120). The characteristic of the images displayed in the plurality of regions PA1, PA2, PA3, and PA4 of the display panel 100 may be determined using the gray values of the plurality of pixels respectively included in the image signal IS displayed in each region.

In an exemplary embodiment, the signal controller 130 determines whether a difference of a maximum gray value and a minimum gray value among the gray values of the plurality of pixels included in the first image signal for the first image is a threshold value or greater, for example.

In another exemplary embodiment, the signal controller 130 determines whether a number of the pixels having a predetermined gray value or less is larger than the number of the pixels having a gray value greater than the predetermined gray value using the gray values of the plurality of pixels included in the first image signal for the first image, for example.

In another exemplary embodiment, the signal controller 130 determines whether the number of the pixels having the first gray value or less and the second gray value or greater is larger than the number of the pixels having a gray value greater than the first gray value and less than the second gray value, for example.

Also, the signal controller 130 selects the gamma curve corresponding to the image characteristic for each region (S130).

In an exemplary embodiment, the signal controller 130 selects the 2.2 gamma curve when the difference of the maximum gray value and the minimum gray value among the gray values of the plurality of pixels included in the first image signal for the first image is the threshold value or greater, for example.

In another exemplary embodiment, the signal controller 130 selects the 2.0 gamma curve when the number of the pixels having a predetermined gray value or less is larger than the number of the pixels having a gray value greater than the predetermined gray value using the gray values of the plurality of pixels included in the first image signal for the first image.

In another exemplary embodiment, the signal controller 130 selects the 2.4 gamma curve when the number of the pixels having the first gray value or less and the second gray value or greater is larger than the number of the pixels having a gray value greater than the first gray value and less than the second gray value.

The operation of determining the image characteristic (S120) and the operation of selecting the gamma curve (S130) may be appropriately modified. In an exemplary embodiment, when the signal controller 130 determines that the difference of the maximum gray value and the minimum gray value among the gray values of the plurality of pixels included in the first image signal is the threshold value or greater, and the number of the pixels having the predetermined gray value or less is larger than the number of the pixels having a gray value greater than the predetermined gray value, the signal controller 130 may appropriately select one of the 2.2 gamma curve and the 2.0 gamma curve, for example.

Next, the signal controller 130 determines the gamma curve difference between the adjacent two regions (S132). In an exemplary embodiment, in the operation of selecting the gamma curve (S130), the signal controller 130 selects the 2.2 gamma curve for the first image and selects the 2.4 gamma curve for the second image, for example. Thus, the signal controller 130 determines whether the gamma curves of the first region PA1 corresponding to the first image and the second region PA2 corresponding to the second image are different.

When the gamma curves between two adjacent regions are different, the signal controller 130 compares the luminance difference between the two regions in the case that two adjacent regions are displayed with the same gamma curve and the luminance difference between the two regions in the case that two adjacent regions are displayed with the selected gamma curves (S134). Also, the signal controller 130 interpolates the gray data of a boundary region of the two regions depending on the comparison result (S136).

In detail, the signal controller 130 may determine the luminance difference using the gray values of the pixels positioned at the regions adjacent to the boundary of two adjacent regions, and may correct the gray value of the boundary region depending on the determination result. This will be described with reference to FIG. 3.

As shown in FIG. 3, when the display panel 100 is divided into the plurality of regions PA1, PA2, PA3, and PA4, the regions EA11, EA12, EA21, EA22, EA31, and EA32 (hereinafter referred to as boundary regions) corresponding to the boundaries of two adjacent regions are respectively positioned in two regions.

In an exemplary embodiment, the boundary region EA11 corresponding to the boundary adjacent to the second region PA2 is positioned in the first region PA1, and the boundary region EA12 corresponding to the boundary adjacent to the first region PA1 and the boundary region EA21 corresponding to the boundary adjacent to the third region PA3 are positioned in the second region PA2, for example. Likewise, the boundary region EA22 corresponding to the boundary adjacent to the second region PA2 and the boundary region EA31 corresponding to the boundary adjacent to the fourth region PA4 are positioned in the third region PA3, and the boundary region EA32 corresponding to the boundary adjacent to the third region PA3 is positioned in the fourth region PA4.

Two adjacent regions may be divided by the gate line. In an exemplary embodiment, the pixels connected to the h-th gate line are included in the first region PA1, and the pixels connected to the (h+1)-th gate line are included in the second region PA2, for example, where h is a natural number.

Also, the boundary region includes the pixels connected to the gate line adjacent to the gate line dividing two regions. In an exemplary embodiment, the boundary region EA11 positioned at the first region PA1 and adjacent to the second region PA2 includes the pixels connected to the (h−3)-th to the h-th gate lines, and the boundary region EA12 positioned at the second region PA2 and adjacent to the first region PA1 includes the pixels connected to the (h+1)-th to the (h+4)-th gate line, for example.

In this case, the number of pixels included in each boundary region may be changed depending on the size of the display panel 100.

In relation to the operation S134, when the case that the gamma curves respectively applied to the first region PA1 and the second region PA2 are different is described as an example, the signal controller 130 may compare the luminance difference using the gray values of the pixels included in the boundary region EA11 and the boundary region EA12 when the gamma curves respectively applied to the first region PA1 and the second region PA2 are different.

In detail, the signal controller 130 may compare the luminance difference when the same gamma curve is applied to the first region PA1 and the second region PA2 and the luminance difference when the selected gamma curves are respectively applied to the first region PA1 and the second region PA2 using the gray values of the pixels connected to the same data line and positioned at the different boundary regions EA11 and EA12.

In an exemplary embodiment, using the gray value of the pixel connected to the data line Di and positioned at the boundary region EA11 and the gray value of the pixel connected to the data line Di and positioned at the boundary region EA12, the luminance difference when the same gamma curve is applied to the first region PA1 and the second region PA2 and the luminance difference when the selected gamma curves are respectively applied to the first region PA1 and the second region PA2 may be compared, for example. This will be further described along with FIG. 4.

Referring to FIG. 4, the gray value of the pixel (hereinafter referred to as a first pixel) positioned at the boundary region EA11 and connected to the data line Di, where i is a natural number, is 70, and the gray value of the pixel (hereinafter referred to as a second pixel) positioned at the boundary region EA12 and connected to the data line Di is 90.

When the same 2.2 gamma curve is applied to the first region PA1 and the second region PA2, the luminance depending on the gray value of the first pixel is L1, and the luminance depending on the gray value of the second pixel is L3. Thus, the luminance difference of the first pixel and the second pixel is L3−L1, i.e., L3 minus L1.

When the 2.2 gamma curve is applied to the first region PA1 and the 2.4 gamma curve is applied to the second region PA2, the luminance depending on the gray value of the first pixel is L1, and the luminance depending on the gray value of the second pixel is L2. Thus, the luminance difference of the first pixel and the second pixel is L2−L1, i.e., L2 minus L1. That is, the value is decreased compared with the luminance difference when the same gamma curve is applied.

To decrease the luminance change due to the gamma curve change between two pixels, the gray value of the second pixel may be compensated to GR2 that is larger than 90 to correspond to the luminance of L2' that is a value between L3 and L2. Thus, the luminance of the second pixel is increased from L2 to L2' depending on the gray value after the compensation such that the luminance change depending on the gamma curve change between two pixels is decreased.

When the 2.2 gamma curve is applied to the first region PA1 and the 1.8 gamma curve is applied to the second region PA2, the luminance depending on the gray value of the first pixel is L1 and the luminance depending on the gray value of the second pixel is L4. Thus, the luminance difference of the first pixel and the second pixel is L4−L1 i.e., L4 minus L1. That is, the value thereof is increased compared with the luminance difference when applying the same gamma curve.

To decrease the luminance change due to the gamma curve change between two pixels, the gray value of the second pixel may be compensated to GR1 that is smaller than 90 to correspond to the luminance of L4' that is a value between L3 and L4. Thus, the luminance of the second pixel is decreased from L4 to L4' depending on the gray value after the compensation such that the luminance change depending on the gamma curve change between two pixels is decreased.

The method of changing the gray value of the second pixel with reference to the first pixel is described above, but the invention is not limited thereto, and the gray value of the first pixel may be changed with reference to the gray value of the second pixel, or the gray values of two pixels may both be changed.

The method of compensating the gray value of two pixels may use various interpolation methods as well as the same linear interpolation method, and is not limited to the above description.

Also, the gray value of the pixels that are positioned at the boundary region EA12 and are connected to the same data line as the first pixel that is not the second pixel may be compensated by the same method as above using the luminance difference from the first pixel. Likewise, the gray value of the pixels that are positioned at the boundary region EA11 and are connected to the same data line as the second pixel that is not the first pixel may be compensated by the same method as above using the luminance difference from the second pixel.

When the gamma curves between two adjacent regions are different, the signal controller 130 outputs the gamma control signal depending on the selected gamma curve and the image data DATA1 to DATA4 generated by compensating the gray value of the pixel included in each boundary region to the data driving ICs 112, 114, 116, and 118 (S140). Also, when the gamma curve between two adjacent regions is not different, the signal controller 130 outputs the gamma control signal depending on the selected gamma curve to the data driving IC 112 (S140). In this case, the gamma control signal may be respectively included in the data control signals CONT1 to CONT4.

The signal controller 130 may differently transmit the gamma control signal for one horizontal pixel line. In an exemplary embodiment, the signal controller 130 data-packetizes the image data applied to the pixel connected to the h-th gate line and the gamma control signal depending on the gamma curve applied to the pixel connected to the h-th gate line to be transmitted to the data driver 110, for example.

The signal controller 130 may transmit the information for the reference gamma voltage satisfying the selected gamma curve corresponding to each region to the data driving IC 112 with reference to the memory 132.

In an exemplary embodiment, the signal controller 130 provides the information for the image data depending on the first image signal and the reference gamma voltage of the 2.2 gamma curve selected corresponding to the first region PA1 to the data driving ICs 112, 114, 116, and 118, for example. Also, the signal controller 130 provides the information for the image data depending on the second image signal and the reference gamma voltage of the 2.4 gamma curve selected corresponding to the second region PA2 to the data driving ICs 112, 114, 116, and 118.

That is, the signal controller 130 determines the characteristic of the image signal displayed in each region, selects the gamma curve corresponding to the determined characteristic, and outputs the signal controlling the data driving IC 112 so that each region satisfies the selected gamma curve, thereby obtaining an effect that the visibility is improved and providing the display device 10 representing the similar luminance for the same gray.

The method of correcting the gray value of the boundary regions when the gamma curve is different between the adjacent regions was described above, but the invention is not limited thereto, and the gamma curve applied to the boundary region may be corrected.

In an exemplary embodiment, when the 2.0 gamma curve is applied to the first region PA1 and the same 2.2 gamma curve is applied to the second region PA2, the 2.1 gamma curve (not shown) having a gamma characteristic between the 2.0 gamma curve and the 2.2 gamma curve may be applied to the boundary region EA11 and the boundary region EA12 respectively included in the first region PA1 and the second region PA2. In this case, the gray correction in the boundary regions EA11 and EA12 may not be performed, for example.

As an example, the data driving IC 112 among the data driving ICs 112, 114, 116, and 118 input with the gamma control signal and the image data is described with reference to FIG. 5.

Figure 5:
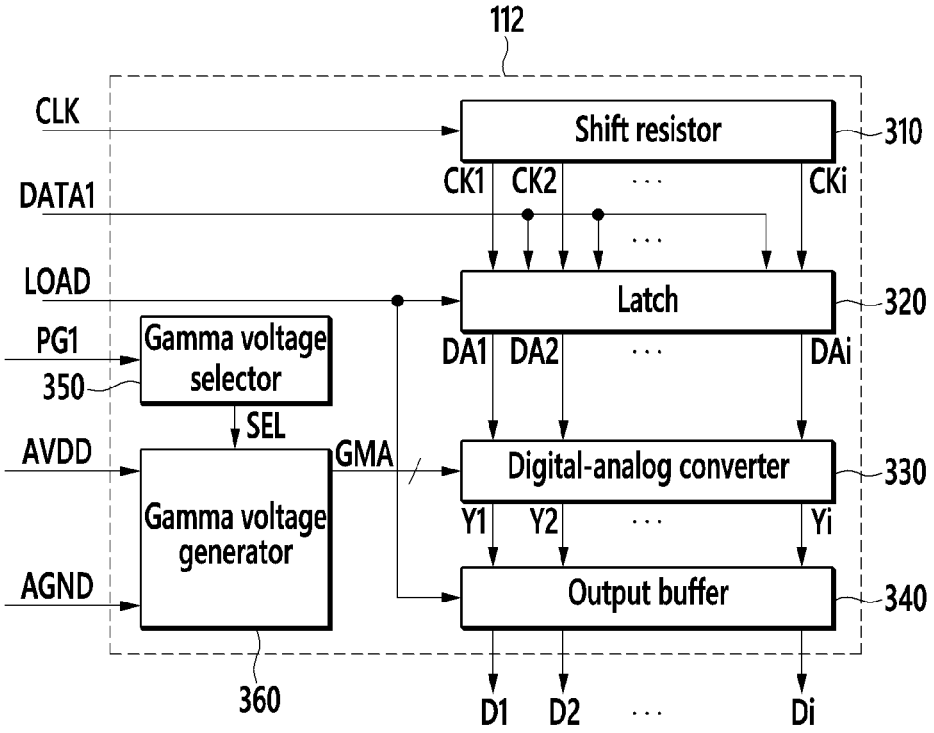
FIG. 5 is a schematic block diagram of an exemplary embodiment of a data driving integrated circuit ("IC") of a display device.

FIG. 5 is a schematic block diagram of the data driving IC 112 of the display device 10 according to an exemplary embodiment. As shown, the data driving IC 112 includes a shift register 310, a latch 320, a digital-analog converter ("DAC") 330, an output buffer 340, a gamma voltage selector 350, and a gamma voltage generator 360.

In FIG. 5, a clock signal CLK, a line latch signal LOAD, and a gamma control signal PG1 are the signals included in the data control signal CONT1 shown in FIG. 1.

First, the shift register 310 sequentially activates latch clock signals CK1 to CKi in synchronization with the clock signal CLK.

The latch 320 latches the image data DATA1 in synchronization with the latch clock signals CK1 to CKi from the shift register 310, and simultaneously provides the latch digital image signals DA1 to DAi to the DAC 330 in response to the line latch signal LOAD.

The DAC 330 outputs the voltages corresponding to the latch digital image signals DA to DAi received from the latch 320 as analog image signals Y1 to Yi to the output buffer 340 using the reference gamma voltage GMA supplied from the gamma voltage generator 360.

The output buffer 340 outputs the analog image signals Y1 to Yi from the DAC 330 to the data lines D1 to Di in response to the line latch signal LOAD.

The gamma voltage selector 350 outputs a signal SEL adjusting the value of the reference gamma voltage GMA to the gamma voltage generator 360 using the information for the reference gamma voltage included in the gamma control signal PG1.

The gamma voltage generator 360 may supply the reference gamma voltage GMA desired in the DAC 330 according to the signal SEL. The gamma voltage generator 360 may output the reference gamma voltage GMA using an inner resistance string.

In an exemplary embodiment, a first voltage AVDD and a second voltage AGND are input to the gamma voltage generator 360, for example. In an exemplary embodiment, the gamma voltage generator 360 may divide the first voltage AVDD and the second voltage AGND into eight reference gamma voltages to be output, for example. In an exemplary embodiment, the gamma voltage generator 360 may output the eight reference gamma voltages GMA having different voltage levels between the first voltage AVDD and the second voltage AGND from a node between internal resistance strings that are connected in series, that is, a plurality of resistors, for example. However, the invention is not limited thereto, and the first voltage AVDD and the second voltage AGND may be divided into any number of reference gamma voltages.

As above-described, when the image data DATA1 output from the signal controller 130 is converted into the analog image signal by the reference gamma voltage GMA supplied from the gamma voltage generator 360 to be supplied to the display panel 100, the display panel 100 displays the image by the analog image signal during one frame period in which the gate signal is supplied through the gate lines G1 to Gm.

Next, a display device 11 according to another exemplary embodiment will be described with reference to FIG. 6.

Figure 6:
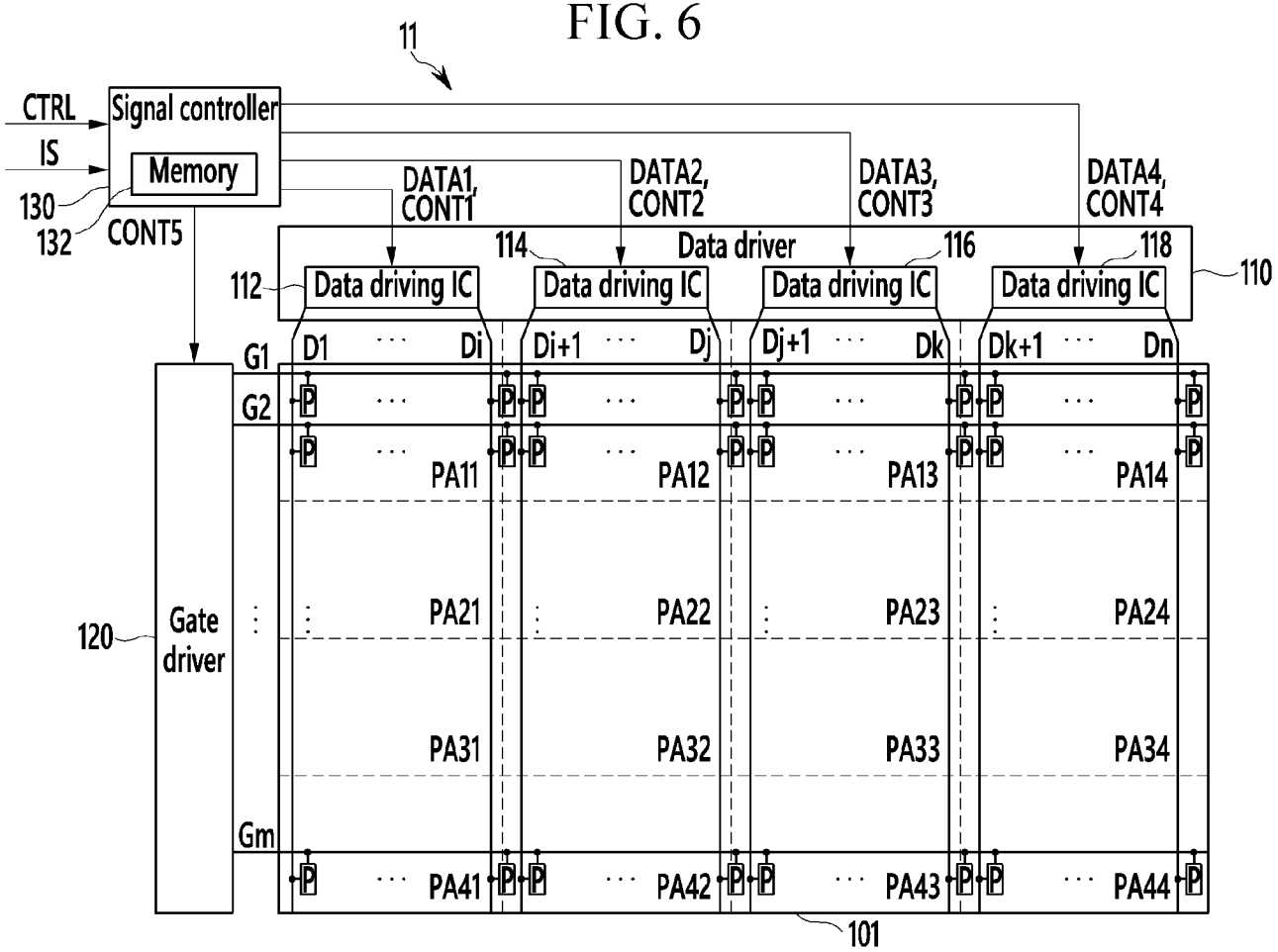
FIG. 6 is a schematic block diagram of another exemplary embodiment of a display device.

FIG. 6 is a schematic block diagram of a display device 11 according to another exemplary embodiment. As shown, the display device 11 includes a display panel 101, a data driver 110, a gate driver 120, and a signal controller 130.

When comparing the display panel 100 of the display device 10 according to the exemplary embodiment of FIG. 1, the display panel 101 of the display device 11 according to the exemplary embodiment of FIG. 6 includes a plurality of regions PA11 to PA44 that are divided by the gate line and the data line.

In detail, the plurality of regions PA11 to PA44 may be further divided with reference to the data lines connected to the different data driving ICs. When the regions PA11 to PA14 including the pixels connected to the same gate line are described, the region PA11 includes the pixels connected to the data lines D1 to Di connected to the data driving IC 112, and the region PA12 includes the pixels connected to the data lines Di+1 to Dj connected to the data driving IC 114 where j is a natural number greater than i. Likewise, the region PA13 includes the pixels connected to the data lines Dj+1 to Dk connected to the data driving IC 116, and the region PA14 includes the pixels connected to the data lines Dk+1 to Dn connected to the data driving IC 118 where k is a natural number greater than j.

In this case, the memory 132 stores a plurality of gamma voltage data corresponding to a plurality of gamma curves for each of a plurality of regions PA11 to PA44. The plurality of gamma voltage data is generated by the same method as that of the gamma voltage data of FIG. 1.

The display device 11 according to the exemplary embodiment of FIG. 6 may be operated according to the driving method of the display device described in FIG. 2. However, since the display device 11 is divided with reference to the data line, the gray value of the region corresponding to all of the boundary region of the regions adjacent in a right/left direction and the boundary region of the regions adjacent in a up/down region may be further corrected. This will be further described with reference to FIG. 7.

Figure 7:
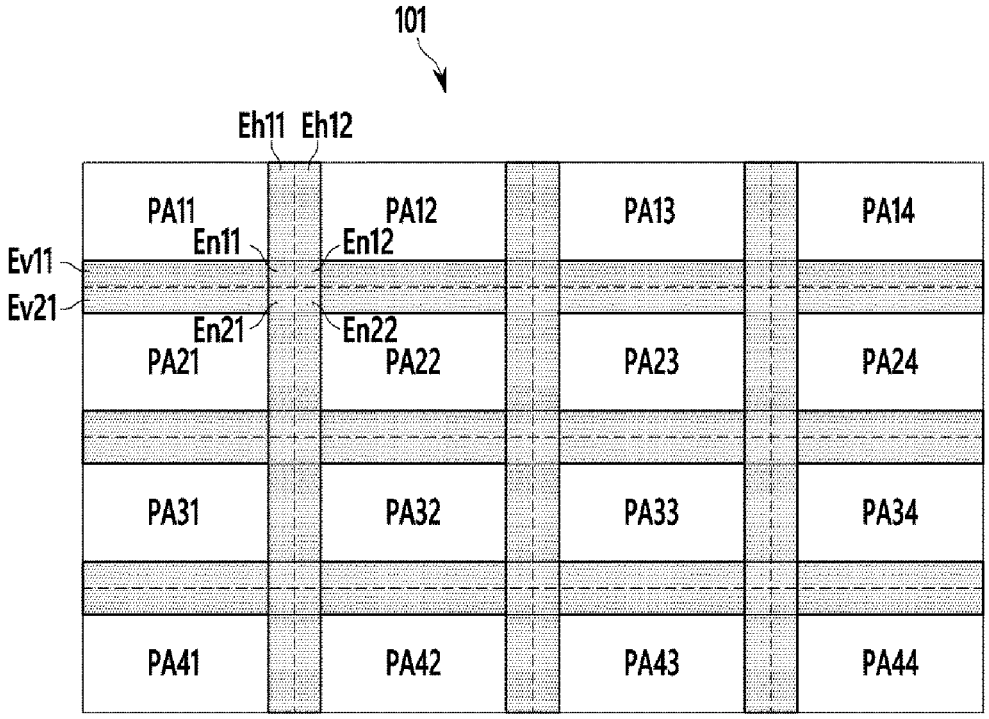
FIG. 7 is a view showing another example of a display panel of a display device.

FIG. 7 is a view showing another exemplary embodiment of the display panel 101 of the display device 11 shown in FIG. 6. As shown, when the display panel 101 is divided into a plurality of regions PA11 to PA44, the region corresponding to the boundary of two adjacent regions is positioned in two regions.

In an exemplary embodiment, the regions Eh11 and Eh12 corresponding to the boundary of two adjacent regions PA11 and PA12 are respectively positioned in two regions PA11 and PA12, and the regions Ev11 and Ev21 corresponding to the boundary of two adjacent regions PA11 and PA21 are respectively positioned in two regions PA11 and PA21, for example.

Also, the overlapped boundary region that is the boundary region of the regions that are adjacent vertically while being the boundary region of the regions that are adjacent horizontally may be positioned in each region. In an exemplary embodiment, the overlapped boundary region En11 is positioned in the region PA11, the overlapped boundary region En12 is positioned in the region PA12, and the overlapped boundary region En21 is positioned in the region PA21, for example.

The signal controller 130 may compare the luminance difference when the same gamma curve is applied to the regions that are adjacent vertically and the luminance difference when the selected gamma curves are respectively applied to the regions that are adjacent vertically using the gray value of the pixels connected to the same data line and positioned at the overlapped boundary regions that are different from each other.

Also, the signal controller 130 may compare the luminance difference when the same gamma curve is applied to the regions that are adjacent horizontally and the luminance difference when the selected gamma curves are respectively applied to the regions that are adjacent horizontally using the gray value of the pixels connected to the same gate line and positioned at the different overlapped boundary regions.

Next, the overlapped boundary region En11 of the case that the gamma curves respectively applied to the region PA11 and the region PA21 are different from each other and the case that the gamma curves respectively applied to the region PA11 and the region PA12 are different from each other will be described as an example.

The signal controller 130 compares the luminance difference when the same gamma curve is applied to the overlapped boundary region En11 and the overlapped boundary region En12 and the first luminance difference when the selected gamma curves are respectively applied to the overlapped boundary region En11 and the overlapped boundary region En12.

Also, the signal controller 130 compares the luminance difference when the same gamma curve is applied to the overlapped boundary region En11 and the overlapped boundary region En21 and a second luminance difference when the selected gamma curves are respectively applied to the overlapped boundary region En11 and the overlapped boundary region En21.

The signal controller 130 compares the first luminance difference and the second luminance difference to determine the overlapped boundary region having the larger difference.

Thus, the signal controller 130, like in the operation S136 shown in FIG. 2, may correct the gray value between the overlapped boundary region En11 and the determined overlapped boundary region. The signal controller 130 may correct the gray value by the same method for each of the overlapped boundary regions.

The display device according to the exemplary embodiments controls the gamma curve applied to each region to be changed according to the characteristic of the image displayed in each region of the display panel, and therefore the visibility of the image may be improved.

Also, the display device according to the exemplary embodiments stores the reference gamma voltage of the region of the display panel relatively far from the data driver and the reference gamma voltage of the region of the display panel relatively close to the data driver 110 as the different values from each other to satisfy the same gamma curve for each region, and therefore the gamma difference for each region may be decreased.

While this invention has been described in connection with what is presently considered to be practical exemplary embodiments, it is to be understood that the invention is not limited to the disclosed exemplary embodiments, but, on the contrary, is intended to cover various modifications and equivalent arrangements included within the spirit and scope of the appended claims.

What is claimed is:

1. A display device comprising:

a display panel including a plurality of pixels and divided into a plurality of regions;

a data driver which generates a plurality of reference gamma voltages based on a gamma control signal, and includes a data driving integrated circuit which applies a data signal generated using the plurality of reference gamma voltages to a corresponding pixel among the plurality of pixels;

a memory which stores a plurality of gamma voltage data corresponding to a plurality of gamma curves of each of the plurality of regions; and a signal controller which determines characteristics of a plurality of images divided and displayed in the plurality of regions using an input image signal, selects a gamma curve of the plurality of gamma curves corresponding to the plurality of regions according to the characteristics, and reads gamma voltage data of the plurality of gamma voltage data corresponding to the selected gamma curve from the memory to generate the gamma control signal, wherein the signal controller corrects a gray value of pixels of the plurality of pixels included in a boundary region of adjacent regions of the plurality of regions when different gamma curves of the plurality of gamma curves are selected in the adjacent regions among the plurality of regions, the boundary region includes a first boundary region and a second boundary region respectively included in the adjacent regions, and the signal controller corrects the gray value of the pixels included in the first boundary region and the second boundary region depending on a luminance difference by the gray value of the pixels include in the first boundary region and the gray value of the pixels include in the second boundary region.

2. The display device of claim 1, further comprising a gate driver which transmits a corresponding gate signal to a plurality of gate lines connected to the plurality of pixels, and the plurality of regions is divided by at least one gate line among the plurality of gate lines.

3. The display device of claim 2, wherein the data driver is connected to the plurality of pixels by a plurality of data lines, and the plurality of regions is further divided by at least one data line.

4. The display device of claim 2, wherein the signal controller packetizes image data depending on the gamma control signal and the input image signal by a unit of the plurality of pixels connected to one gate line to be transmitted to the data driver.

5. The display device of claim 1, wherein the signal controller determines the characteristics using a gray value of the plurality of pixels included in a plurality of image signals.

6. The display device of claim 1, wherein the signal controller corrects the gray value of the pixels included in the first boundary region and the second boundary region based on a difference between the luminance based on the gray value of the pixel included in the first boundary region and the luminance based on the gray value of the pixel included in the second boundary region for the same gamma curve to offset an increase or decrease of the difference between the luminance depending on the gray value of the pixel included in the first boundary region and the luminance depending on the gray value of the pixel included in the second boundary region for the different gamma curves.

7. The display device of claim 1, wherein the gamma voltage data is generated using the luminance measured by providing a plurality of test voltages corresponding to a plurality of sample grays to the plurality of regions.

8. A method for driving a display device, the method comprising:

receiving an image signal;

determining characteristics of a plurality of images divided according to a plurality of regions of a display panel displaying an image according to the image signal;

selecting gamma curves corresponding to the plurality of regions depending on characteristics;

reading gamma voltage data of a plurality of gamma voltage data corresponding to the selected gamma curve from a memory in which the plurality of gamma voltage data of a plurality of gamma curves of each of the plurality of regions to generate a gamma control signal;

generating a plurality of reference gamma voltages based on the gamma control signal;

determining whether gamma curves which are different from each other are selected in adjacent regions among the plurality of regions; and correcting a gray value of the pixels included in a boundary region of the adjacent regions depending on a determination result, wherein the correcting the gray value includes:

correcting the gray value of the pixels included in the first boundary region and the second boundary region depending on a luminance difference by the gray value of the pixels included in the first boundary region and the gray value of the pixels included in the second boundary region when the boundary region includes a first boundary region and a second boundary region which are respectively positioned at the adjacent regions.

9. The driving method of claim 8, wherein the determining the characteristics includes:

determining the characteristics using a gray value of pixels included in a plurality of image signals.

10. The driving method of claim 8, wherein the correcting the gray value of the pixels included in the first boundary region and the second boundary region includes:

correcting the gray value of the pixels included in the first boundary region and the second boundary region based on a difference between the luminance depending on the gray value of the pixel included in the first boundary region and the luminance depending on the gray value of the pixel included in the second boundary region for the same gamma curve to offset an increase or decrease of the difference between the luminance depending on the gray value of the pixel included in the first boundary region and the luminance depending on the gray value of the pixel included in the second boundary region for different gamma curves of the plurality of gamma curves.

11. The driving method of claim 8, wherein the generating the gamma control signal includes packetizing image data depending on the gamma control signal and the image signal by a unit of one horizontal line.

* * * * *